US005363869A

United States Patent [19]

McDowell

[11] Patent Number: 5,363,869

[45] Date of Patent: Nov. 15, 1994

[54] PAINT ROLLER CLEANING ASSEMBLY

[76] Inventor: James McDowell, R.R. 1, Box 469 C, Eaton, N.Y. 13334

[21] Appl. No.: 121,685

[22] Filed: Sep. 15, 1993

[51] Int. Cl.[5] ..... B08B 3/02

[52] U.S. Cl. ..... 134/104.2; 134/138; 134/900

[58] Field of Search ..... 134/900, 138, 153, 104.2, 134/104.4

[56] References Cited

U.S. PATENT DOCUMENTS

| | | | |
|---|---|---|---|
| 2,831,488 | 4/1958 | Anderson | 134/900 X |
| 3,037,516 | 6/1962 | Leach | 134/900 X |
| 3,075,534 | 1/1963 | Habostad | 134/900 X |
| 3,577,280 | 5/1971 | George | 134/900 X |
| 3,688,785 | 9/1972 | Stevens et al. | 134/900 X |
| 4,377,175 | 3/1983 | Fritz | 134/138 |
| 4,402,333 | 9/1983 | Frizzell et al. | 134/900 X |
| 4,641,673 | 2/1987 | Conley et al. | 134/900 X |
| 4,672,987 | 6/1987 | Brandt | 134/900 X |
| 4,700,728 | 10/1987 | Patterson | 134/900 X |
| 4,832,066 | 5/1989 | Shipman | 134/900 X |
| 5,005,598 | 4/1991 | Hodgdon | 134/900 X |
| 5,050,626 | 9/1991 | Brockage et al. | 134/900 X |
| 5,095,928 | 3/1992 | Phipps | 134/900 X |

FOREIGN PATENT DOCUMENTS

| | | | |
|---|---|---|---|
| 2439835 | 3/1976 | Germany | 134/900 |
| 2072001 | 9/1981 | United Kingdom | 134/900 |

*Primary Examiner*—Philip R. Coe

*Attorney, Agent, or Firm*—Harris Beach & Wilcox

[57] ABSTRACT

A roller cleaning assembly for cleaning water-soluble paint from a paint roller cover has two major components, namely an enclosure and a spray jet component. The enclosure has a rigid sidewall, preferably of rectangular cross section, open at the bottom to permit free drainage and has a top wall with a central round opening of sufficient diameter to accommodate the roller cover. A u-shaped channel can grip the neck portion of the roller handle. The jet component is biased by a spring-like interference fit in the interior of the enclosure. A jet component has an inlet tube with a female fitting to attach to a source of water, and first and second riser pipes that rise from the inlet tube and which contain jet outlets that are spaced at intervals. The riser pipes direct jets of water and the roller cover to dislodge paint from the nap and to impart a spin to the roller. A bracket can be employed to mount the enclosure on a tank or bucket.

8 Claims, 3 Drawing Sheets

PAINT ROLLER CLEANING ASSEMBLY

BACKGROUND OF THE INVENTION

This invention relates to a technique for cleaning paint roller covers, and is more particularly concerned with an assembly for water cleaning of paint roller covers when utilized for applying water based paints and coatings.

There have been several apparatus proposed for cleaning paint-soaked rollers, many of which involve spraying water onto the roller while it is supported on the roller holder of the paint roller handle. Several of these paint roller cleaner devices involve an enclosure or tank in which the paint roller is supported, and a water jet that extends parallel to the paint roller and has a series of jet outlets from which water impinges onto the roller cover. The jet action penetrates the fibers of the roller cover to remove the paint, and also can impart a rotation or spin to the roller. Stevens et al. U.S. Pat. No. 3,688,785; Conley et al. U.S. Pat. No. 4,641,673; George U.S. Pat. No. 3,577,280; Brandt U.S. Pat. No. 4,672,987; Hodgdon U.S. Pat. No. 5,005,598; Brockage et al. U.S. Pat. No. 5,050,626; Habostad U.S. Pat. No. 3,075,534; Phipps U.S. Pat. No. 5,095,928; and Shipman U.S. Pat. No. 4,832,066 show a typical assortment of these proposed roller cleaners.

These devices tend to have a large number of parts, including clamps for holding and, in many cases, pivoting the roller or its handle, or some means to rotate the direction of the water jets within the housing. The devices typically employ only a single water jet pipe and so the jets impinge onto only one side of the roller. The device shown in the Shipman patent, although having a pair of spray pipes, requires a rather cumbersome bracket for holding the paint roller handle, and has a multiple-part housing or enclosure that has to be installed over the paint roller before cleaning.

None of these designs have been particularly popular, largely because of their complexity and the difficulties involved in the installation and cleaning of the paint rollers.

OBJECTS AND SUMMARY OF THE INVENTION

It is an object of this invention to provide an effective yet simple paint roller cleaning assembly which avoids the drawbacks and shortcomings of the prior art.

It is more particularly an object of this invention to provide an effective paint roller cleaner having at most two principal parts which snap fit together.

It is another object to provide a paint roller cleaner in which staggered rows of jets are directed at the roller from opposite sides.

It is a further object to provide a paint roller cleaner that facilitates installation of the roller assembly therein for cleaning.

According to an aspect of this invention, the roller cleaning assembly has two major components; an enclosure and a spray jet component. The enclosure has a rigid side wall, preferably of rectangular cross section, which is open at the bottom to permit free drainage from the housing, and also has a top wall that has a central round opening of sufficient diameter to accommodate the roller cover of the paint roller. The paint roller cover, mounted on the roller holder, is inserted down through this opening into the interior of the enclosure. The neck portion of the roller handle, which typically projects at 90 degrees from one end of the roller holder, is supported in a channel on the top wall. This can be in the form of a reversible insert that can accommodate either of two sizes of roller handles.

The jet component is supported by a spring-like interference fit in the interior of the enclosure. This component has an inlet tube with a female fitting to attach to a source of a suitable paint solvent. For cleaning water-based paints, e.g. latex paints, this can attach to a common garden hose. First and second riser pipes rise from the inlet tube within the enclosure on opposite sides thereof. These riser pipes have jet outlets spread at intervals along them, and direct jets of water (or other solvent) at the roller cover. Preferably, the first and second risers have their jet outlets at staggered positions, so that the positions of the jet outlets of the first riser pipe are located between positions of the jet outlets of the second riser pipe.

A bracket can be employed with this assembly to mount the enclosure removably on a tank or bucket. This permits the water and paint from the cleaning operation to be retained, so that the solids can be separated to prevent contamination of waste water processing facilities.

The above and many other objects, features, and advantages of this invention will become apparent from the ensuing description of a preferred embodiment which should be read in conjunction with the accompanying Drawing.

DETAILED DESCRIPTION OF THE PREFERRED EMBODIMENT

Figure 1:
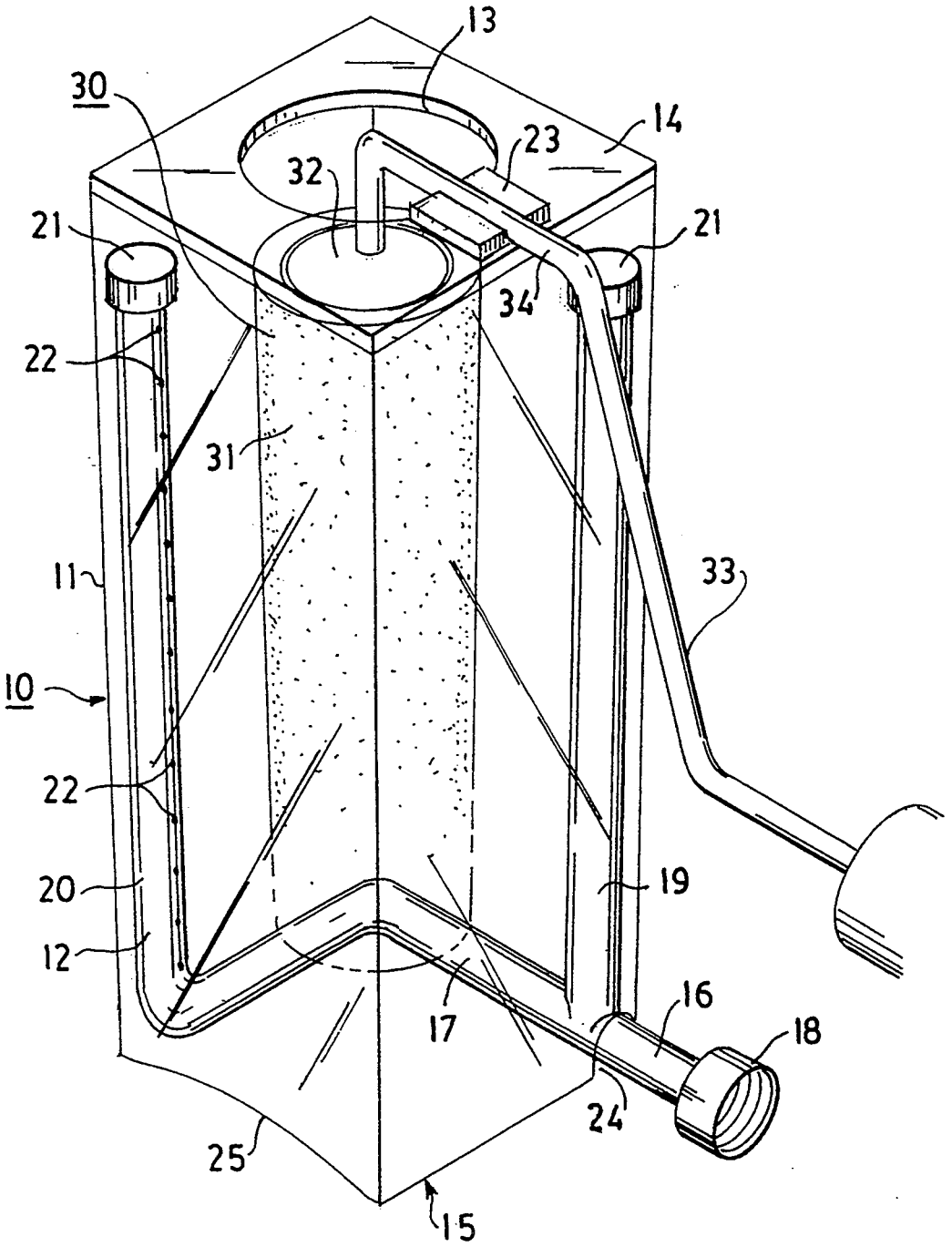
FIG. 1 is a perspective view of a paint roller cleaning assembly according to one embodiment of this invention.

With reference to the Drawing, and initially to FIG. 1, the paint roller cleaning assembly 10 is a simple, yet effective means for cleaning water soluble paints from a paint roller. A cover or enclosure 11 is molded from a rigid transparent plastic. The enclosure 11 has a rigid side wall 12 of rectangular, preferably square, cross section, and a rigid top wall 14 in which a circular opening 13 is cut. The opening 13 has a diameter sufficient to accept a roller cover with a nap of standard thickness. The enclosure 11 has an open bottom 15 which permits free drainage from the assembly of the water or other solvent together with any paint that has been washed out from the cover. A water pipe component 16 fits by inherent spring action, i.e., an interference fit, into the interior of the enclosure 11. This component 16 is formed of an L-shaped inlet tube 17 having a female hose coupling 18 at one end, and which divides into first and second risers 19 and 20. The risers are tubes that are disposed at opposite corners of the enclosure.

There are end caps 21 on the upper ends of the riser tubes, and the tubes 19, 20 have jet outlets 22 spaced at regular intervals therealong. A handle rest insert 23 is fitted into a slot that is cut adjacent the opening 13 in the top wall 14. This insert 23 is reversible to accommodate different sizes of roller handles. Also shown in FIG. 1 are an arcuate cutout 24 at a lower edge of the side wall 12 to accommodate the inlet tube 17, and an arcuate lower edge 25 on the side wall 12 to ensure that there is outflow of the water or other discharge from the operation of the cleaner assembly 10.

As also shown, the paint roller 30 has a paint cover 31 formed of a rigid core and a fiber nap layer. The cover is fitted onto a rotary roller holder 32, permitting the roller cover to rotate on a transverse axis. A handle frame 33 for the paint roller has a neck portion 34, formed for example of a rigid wire of either ¼ inch or ⅜ inch diameter, extending perpendicularly from one end of the roller holder 32.

Figure 2:
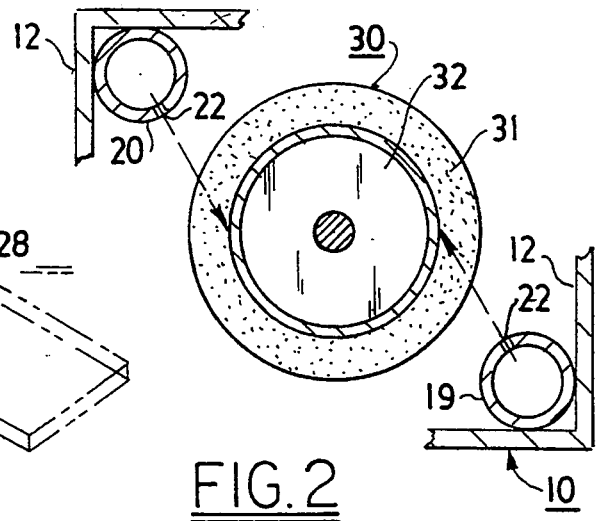
FIG. 2 is a schematic partial cross section of the assembly of FIG. 1.

As shown in FIG. 2, the outlets 22 of the first and second risers 19 and 20 are aimed so that the water jets impact the roller cover on opposites sides of the axis. The jet impact is preferably tangent to the interface of the core and the nap. This ensures spin action is imparted to the roller during a cleaning operation. Also, the risers 19 and 20 are angled out somewhat, so that when the water jet component 16 is installed inside the enclosure 11, the risers 19 and 20 will press against the interior surfaces of the side wall 12 to hold the component 16 in place. No additional clamping parts are required to hold the component 16.

Figure 3:
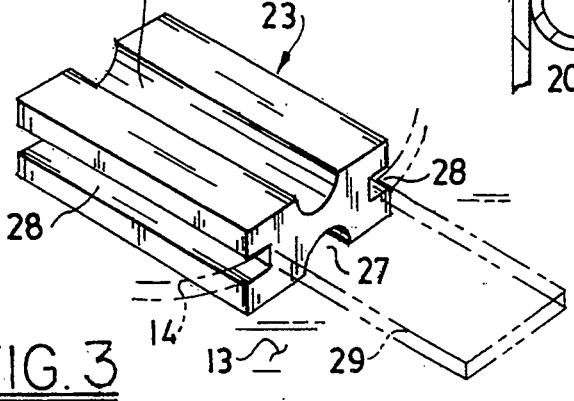
FIG. 3 shows a reversible insert employed in this embodiment.

As shown in FIG. 3, the handle rest 23 is an insert formed of hard rubber or a similar rubberized polymer, having upper and lower surfaces. First and second U-shaped channels 26 and 27, of respective diameters of ¼ inch and ⅜ inch, grip the neck portion 34 of the paint roller handle when the roller 30 is installed in the assembly 10 for cleaning. Grooves 28 are provided on the side edges of the insert. These slidably receive edges of the cutout 29 (shown in ghost) so the insert 23 can be slid out and reversed and slid back in to the cutout 29 to accommodate either size rod normally used in the paint roller handle.

Figure 4:
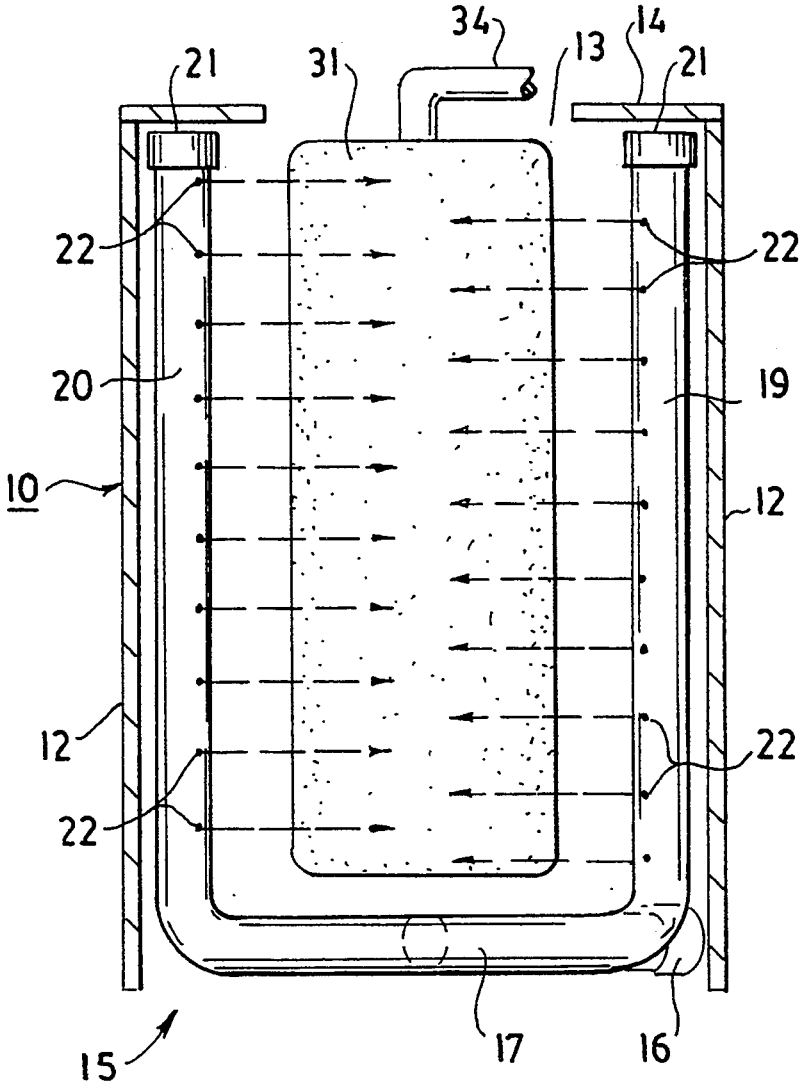
FIG. 4 is an elevational schematic view of this embodiment.

Shown in FIG. 4, the jet outlets 22 are staggered alternately; that is the outlets 22 on the riser 19 are midway between the positions of the jet outlets 22 on the other riser 20. This arrangement permits a more thorough cleaning of the paint roller, and eliminates bands or ridges in the paint roller cover.

Figure 5:
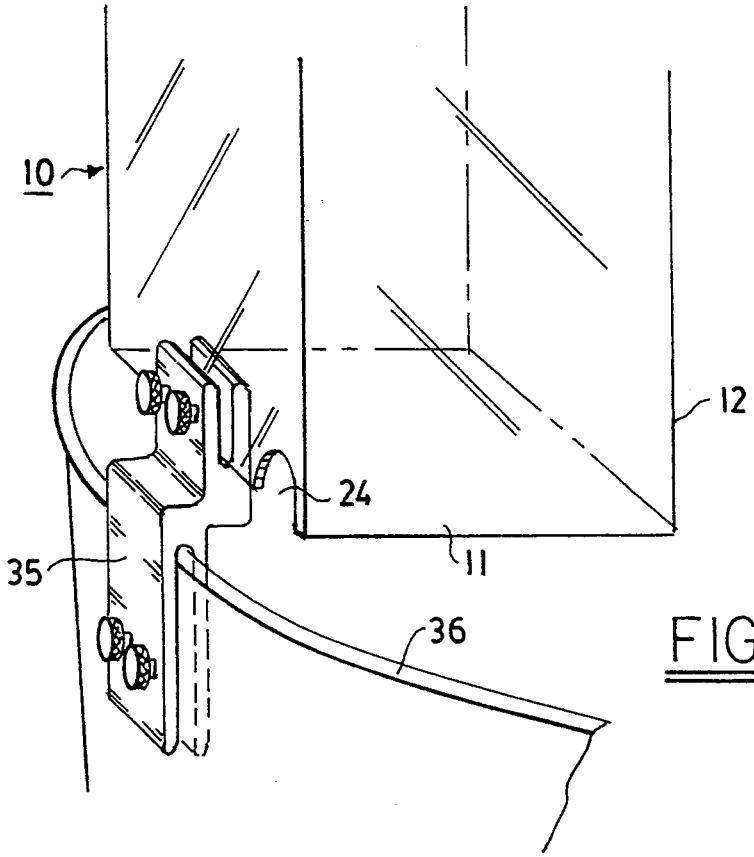
FIG. 5 is a partial perspective view illustrating mounting of the assembly on a holding tank or bucket.

The clamp or bracket 35 shown in FIG. 5 mounts the assembly 10 on a pail, bucket, or tank 36. This permits the water and suspended paint solids from cleaning the roller to be retained. The solids can settle out in the pail or tank 36 before the water is discarded. The bracket 35 as shown is but one example, and many other brackets, of entirely different shape or material could be employed.

The use of the clear material, e.g., plexiglass in the enclosure 11 permits the operator to monitor the cleaning operation.

The operation of this device is as follows: A garden hose, utility sink adapter, or other source of water under pressure is connected to the female coupling 18 of the inlet tube 17. The paint roller 30 is inserted through the circular opening 13 so that the roller cover 31 is disposed entirely within the enclosure 11. The neck 34 of the paint roller is then lodged into the appropriate channel 26 or 27 of the insert 23.

The water pressure is then turned on and water is forced through the jet component 16. Jets of water emanate from the jet outlets 22 in the risers 19, 20 and impinge onto the roller cover 31. Jets are oriented so that the pressurized water strikes the roller at an angle tangent to the perimeter of its core. This spins the roller as shown in FIG. 2. The pressurized spray of water, in conjunction with the centrifugal force created by spinning action, dislodges the paint from the nap, and the paint is then rinsed away. The water jets, being vertically offset as described previously, create maximum cleaning coverage and restore the nap to its original condition. Typical cleaning time is approximately 30 seconds.

Alkyd and oil-based paints can be cleaned from paint rollers using an assembly of similar design, but in which a suitable organic solvent is applied through the jet component 16.

While this invention has been described in detail with respect to one preferred embodiment, it should be understood that the invention is not limited to that precise embodiment. In particular, the apparatus could be oriented in any direction with respect to the paint roller cover; it is only required that drainage be provided from the bottom of the enclosure and that the paint roller holder is supported so it remains fixed, while the paint roller can freely rotate. This can be achieved with minor modifications of the preferred embodiment. For example, the handle grip inset could be fitted with a thumb screw to prevent slippage of the paint roller handle.

In an alternate embodiment, the entire apparatus may be molded as a single unit.

Concerning the placement of the water inlet, the preferred embodiment is designed for use with a garden hose. The inlet at the bottom allows for greater stability in such an instance. However, an embodiment having the inlet on top would be more convenient to use in a utility sink.

In addition, the number of pipes used is not critical; it is possible to use as few as one or as many as four. The preferred embodiment provides thoroughness of cleaning with simplicity of manufacture.

Thus, as can be seen, many modifications and variations would present themselves to those skilled in the art without departing from the scope and spirit of this invention, as defined in the appended claims.

What is claimed is:

1. A paint roller cleaning assembly for cleaning paint from a roller cover that is mounted on a handle that includes a transverse roller holder that is supported at one end on a neck that extends substantially perpendicular to the roller holder, with said roller cover being mounted on the roller holder; the cleaning assembly comprising:

an enclosure formed of a side wall and a top with an open bottom wall to permit free drainage therefrom, wherein said top has an opening of sufficient diameter for insertion of said roller cover therethrough, and including means on said top for positioning and supporting the neck of said roller handle with the associated roller holder and roller cover projecting inwardly through said opening entirely within said enclosure; and jet means supported within said enclosure for spraying a suitable solvent onto the roller cover, including an inlet tube having a fitting to couple to a source of said solvent, and two pipes disposed parallel with a rotation axis of the roller cover, said two pipes extending from said inlet tube within said enclosure on opposite sides thereof, and said two pipes having jet outlets at spaced intervals therealong directing jets of said solvent onto the roller cover; wherein and said two pipes are biased resiliently outwards in contact with an interior of said enclosure so that said jet means is held in place in said enclosure by an interference fit of said two pipes against the interior of the enclosure.

2. A paint roller cleaning assembly according to claim 1 wherein said side wall is generally rectangular in cross section.

3. A paint roller cleaning assembly for cleaning paint from a roller cover that is mounted on a handle that includes a transverse roller holder that is supported at one end on a neck that extends substantially perpendicular to the roller holder, with said roller cover being mounted on the roller holder; the cleaning assembly comprising:

an enclosure formed of a side wall and a top wall with an open bottom wall to permit free drainage thereform, wherein said top wall has an opening of sufficient diameter for insertion of said roller cover therethrough, and including means on said top wall for positioning and supporting the neck of said roller handle with the associated roller holder and roller cover projecting inwardly through said opening entirely within said enclosure; and jet means supported within said enclosure for spraying a suitable solvent onto the roller cover, including an inlet tube having a fitting to couple to a source of said solvent, and at least one pipe that is parallel with a rotation axis of the roller cover, said at least one pipe extending from said inlet tube within said enclosure, and said at least one pipe having jet outlets at space intervals therealong directing jets of said solvent onto the roller cover;

wherein said means for positioning and supporting the neck of the paint roller holder includes a reversible insert fitted into receptacle means on said top wall having channels of different sizes on opposite sides thereof.

4. A paint roller cleaning assembly according to claim 3 wherein said at least one pipe comprises two pipes.

5. A paint roller cleaning assembly according to claim 3 wherein said reversible insert has generally u-shaped channels on opposite side walls thereof, and said receptacle means includes a cutout in said top wall connected to said central opening, and having edges that slidably engage the grooves on said insert.

6. A paint roller cleaning assembly according to claim 1 wherein said two pipes each have their jet outlets directed to opposite sides of the rotation axis of the roller holder and cover, so as to impart a rotation to said cover while cleaning the same.

7. A paint roller cleaning assembly according to claim 1 wherein said two pipes have their jet outlets at staggered positions so that the positions of the jet outlets of a first pipe are located intermediate the positions of the jet outlets of a second pipe.

8. A paint roller cleaning assembly according to claim 1 further comprising bracket means for removably holding said enclosure onto the rim of a bucket so that the drainage of said solvent out the bottom wall of said enclosure is contained in the bucket.

* * * * *